US005964172A

United States Patent [19]

Ikeda

[11] Patent Number: 5,964,172

[45] Date of Patent: Oct. 12, 1999

[54] SEAT ASSEMBLY FOR WATERCRAFT

[75] Inventor: Keijiro Ikeda, Iwata, Japan

[73] Assignee: Yamaha Hatsudoki Kabushiki Kaisha, Japan

[21] Appl. No.: 08/900,966

[22] Filed: Jul. 25, 1997

[30] Foreign Application Priority Data

Jul. 25, 1996 [JP] Japan ..... 8-196003

[51] Int. Cl.[6] ..... B63B 17/00

[52] U.S. Cl. ..... 114/55.57; 114/363

[58] Field of Search ..... 114/363, 362, 114/270, 55.5, 55.57; 297/195.1, 195.11–195.13, 215.1–215.14

[56] References Cited

U.S. PATENT DOCUMENTS

| | | | |
|---|---|---|---|
| 4,318,700 | 3/1982 | Price . | |
| 4,466,660 | 8/1984 | Mabie | 297/195.1 |
| 5,026,119 | 6/1991 | Frank et al. | 297/383 |
| 5,320,059 | 6/1994 | Ikeda | 114/363 |
| 5,406,904 | 4/1995 | Kobayashi | 114/363 |
| 5,537,948 | 7/1996 | Kobayashi . | |
| 5,544,937 | 8/1996 | Hanagan . | |
| 5,676,086 | 10/1997 | Watkins . | |

FOREIGN PATENT DOCUMENTS

| | | | |
|---|---|---|---|
| 55288 | 3/1987 | Japan | 114/363 |

*Primary Examiner*—Ed Swinehart
*Attorney, Agent, or Firm*—Knobbe, Martens, Olson & Bear, LLP

[57] ABSTRACT

An improved watercraft and seat design that provides back support for one or more riders of small watercraft. The watercraft includes a moveable rider support, pivotally mounted to the upper deck of the watercraft. This rider support may be pivoted to a number of predetermined positions, dependent upon the number of riders on the watercraft. Handles and a grip are provided for the riders' use. This rider support may be alternately be used as support stand for an inverted watercraft during underbelly maintenance of the craft. Furthermore, the improved watercraft design of the present invention provides an increased flow of cooling air to the riders of the watercraft.

21 Claims, 12 Drawing Sheets

SEAT ASSEMBLY FOR WATERCRAFT

FIELD OF THE INVENTION

This invention relates to the field of small watercraft and, more particularly, to a moveable rider support for use on a small watercraft.

DESCRIPTION OF RELATED ART

Personal watercraft have become popular in recent years. This type of watercraft is sporting in nature; it turns swiftly, is easily maneuverable, and accelerates quickly. A personal watercraft today commonly carries one rider and possibly one or two passengers.

A relatively small hull of the personal watercraft, comprising an upper deck and a lower hull, commonly defines a riders' area above an engine compartment. An internal combustion engine frequently powers a jet propulsion unit in a tunnel formed on the underside of the watercraft hull, which propulsion unit propels the watercraft. The engine lies within the engine compartment, below the riders' area. The engine is generally accessed by removal of a panel in the hull, which is typically part of the riders' seat. In addition, various components of the watercraft requiring periodic maintenance and/or repair are located on the underbelly of the watercraft.

While originally designed for the recreational use of a single rider, personal watercraft have increased in size and versatility and are currently used in many diverse areas other than personal recreation, such as lifeguard rescue, public safety and military uses, among others. However, the predominant use of these small watercraft remains recreational.

SUMMARY OF THE PRESENT INVENTION

While it has become commonplace for small watercraft, such as, for example, personal watercraft, to carry multiple riders on a single, centrally located elongated seat, prior personal watercraft designs have failed to provide an upper/middle back support for these riders. This is partially due to the "stacked" position in which the riders sit on the elongated seat, and the limited rider space in the watercraft. In order to provide support for the driver of the watercraft, an upper/middle back support would necessarily be located directly behind the driver, in the approximate location that a second rider occupies on the elongated seat. Similarly, a middle/back support for the second rider would displace a third rider on the elongated seat.

While it is possible to divide the elongated seat of a small watercraft into distinct portions, each with an individual upper/middle back support, such a design would add great expense to the small watercraft, would unacceptably extend the length of the elongated seat, and would prevent riders of the small watercraft from assuming the "stacked" or tandem seating position if they so desired.

In accordance with one aspect of the present invention there is provided a movable rider support design for use by single and/or multiple riders in a watercraft. The rider support comprises a support rest which is movably coupled to an upper deck portion of the watercraft hull. This coupling permits the support rest to be moved between at least a first position and a second position along a longitudinal axis of the watercraft and relative to the seat.

Another aspect of the present invention involves a small watercraft comprising a hull that has an upper deck portion. A seat is positioned on the upper deck portion of the hull, and a rider support is located near the seat. The rider support comprises a support rest that is supported generally above the seat by at least one support arm. A pivotal coupling rotatably fixes the support arm to the upper deck portion of the hull. In one embodiment, the support arm rotates between a discrete position to locate the support rest at predetermined positions relative to the seat.

Further aspects, features and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present watercraft. The illustrated embodiments are intended to illustrate, but not to limit, the invention. The drawings contain the following figures.

DETAILED DESCRIPTION OF THE PREFERRED EMBODIMENT

Figure 1:
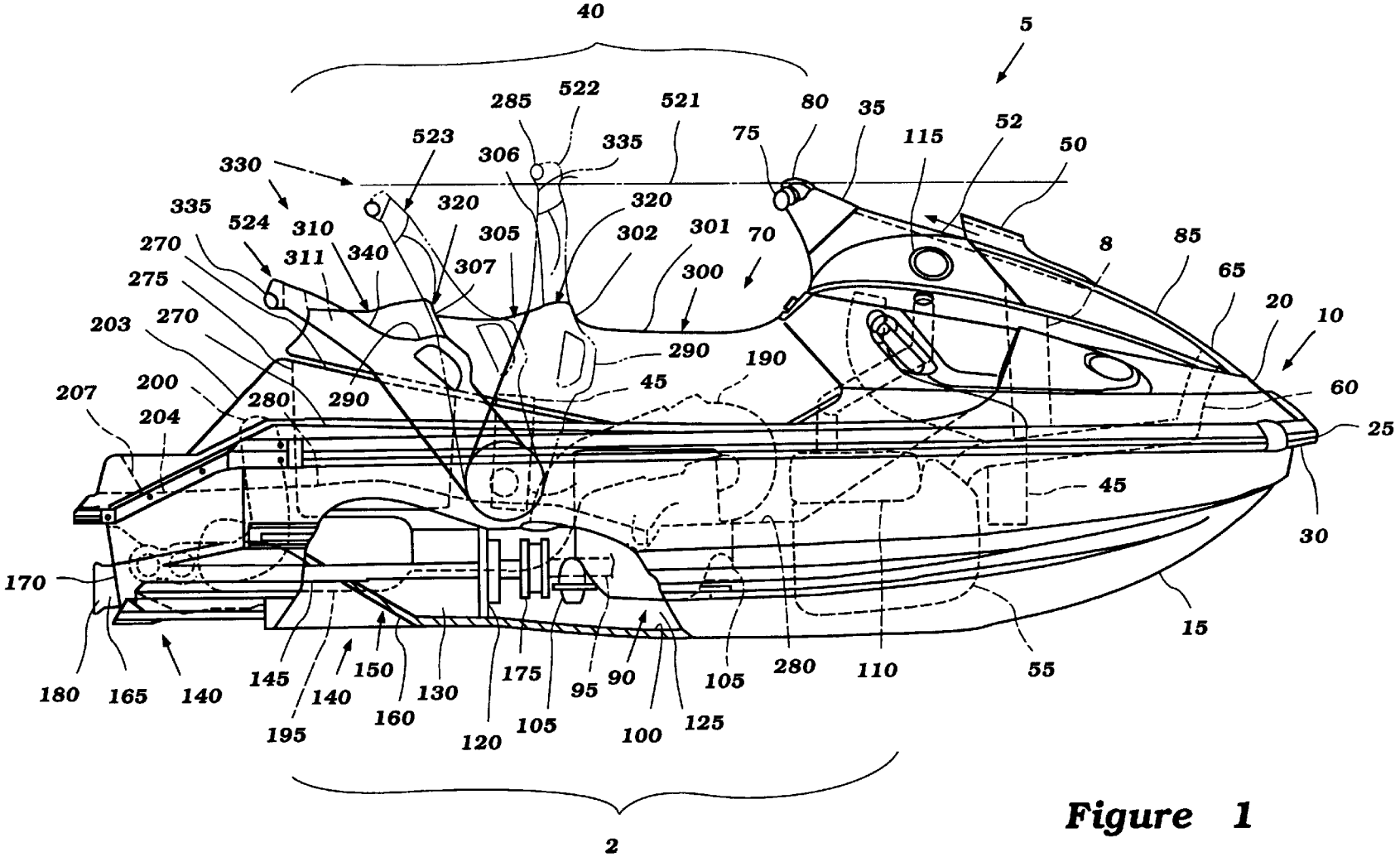
FIG. 1 is a partial sectional, side elevational view of an embodiment of the present invention, partially broken away to show a section of the engine compartment, with several other internal components of the watercraft illustrated in phantom.
Figure 2:
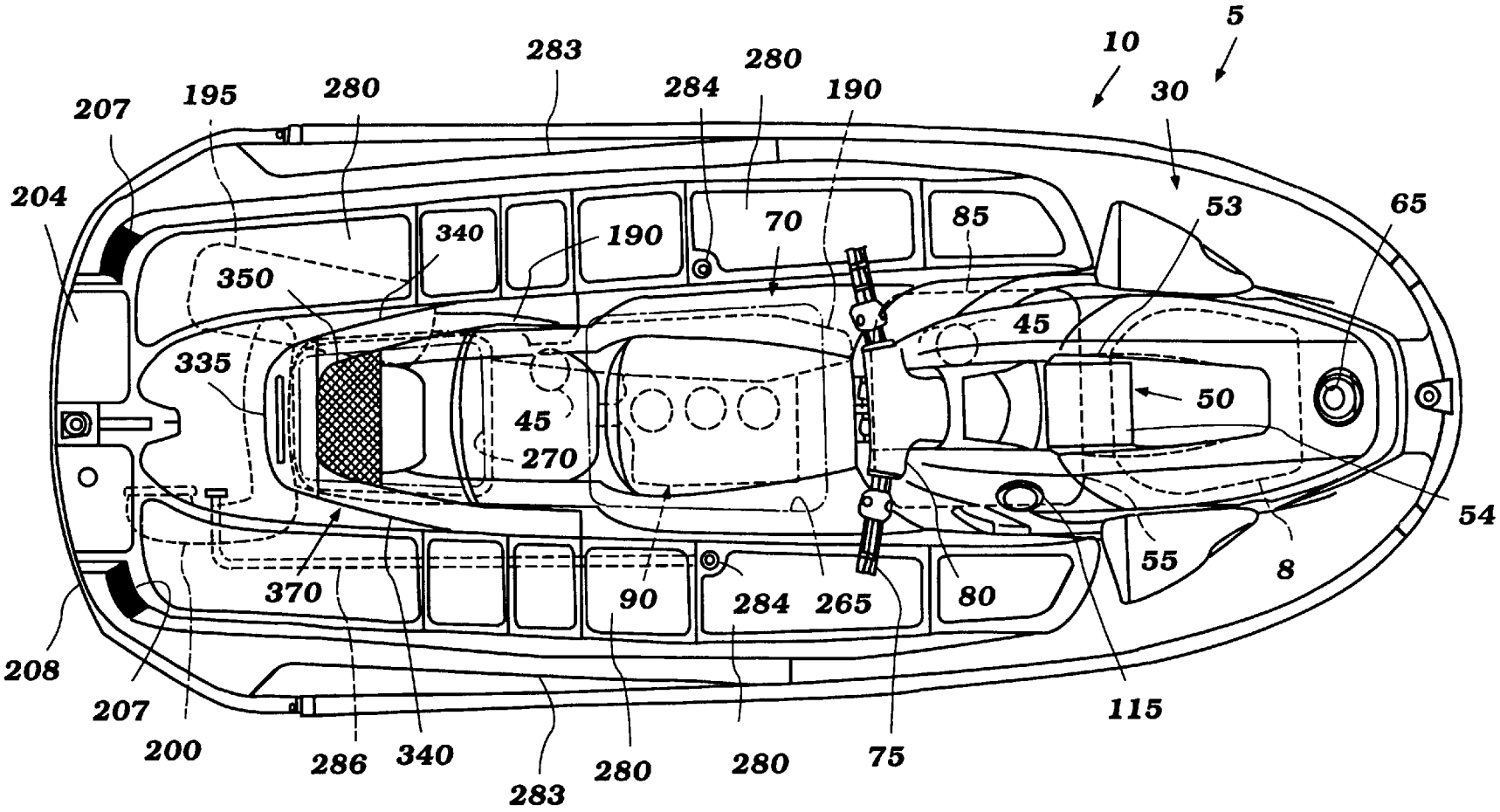
FIG. 2 is a top plan view of the small watercraft of FIG. 1, with several internal components of the watercraft illustrated in phantom.

FIGS. 1 and 2 illustrate a small watercraft incorporating a seat configured in accordance with a preferred embodiment of the present invention. While the present rider support assembly has particular utility with a seat assembly in which occupants of the small watercraft ride tandem, the present invention may also be utilized on small watercraft that incorporate other seat arrangements, such as side-by-side seating. As such, the seat assembly has particular utility in connection with personal watercraft, and the following will describe the present seat assembly in this context; however, it is understood that the seat assembly can also be employed on other types of watercraft.

With initial reference to FIGS. 1 and 2, a small watercraft, indicated generally by reference numeral 5, includes a hull 10 formed by a lower hull section 15 and an upper deck section 20. These hull sections 15, 20 are formed from a suitable material such as, for example, a molded fiberglass reinforced resin. The lower hull section 15 and the upper deck section 20 are fixed to each other around the peripheral edges 25 in any suitable manner commonly known to those skilled in the art.

As viewed in a direction from the bow to the stem of the watercraft, the upper deck section 20 includes a bow portion 30, a control mast 35 and a rider's area 40. The bow portion 30 slopes upwardly toward the control mast 35 and includes at least one air duct 45 through which air can enter the hull 10. A lid or cover 52 desirably extends above an upper end of the air duct 45 to inhibit an influx of water into the hull 10.

The control mast 35 extends upward from the bow portion 30 and supports a handlebar assembly 75. The handlebar assembly 75 controls the steering of the watercraft in a conventional manner well known to those skilled in the art. The handlebar assembly also carries a variety of the controls of the watercraft such as, for example, a throttle control, a start switch and a lanyard switch. The handlebar assembly 75 is enclosed by a handle cover 80 and is pivotally provided in front of the seat 70.

A hatch cover 85 is provided in front of the steering handle 75. The hatch cover 85 is able to open and close freely, thereby exposing the forward section of the interior of the hull 10. A latch (not shown) is provided to secure the hatch cover 85 in its closed position during operation of the watercraft 5. A storage box 8 is removably provided in the deck below the hatch cover 85. This storage box 8 is covered by the hatch cover in a water sealing manner.

An air duct opening 50, located on top of the hatch cover 85, desirably collects ambient air traveling over a portion of the hatch cover and directs this airflow onto the rider(s) of the watercraft. In the disclosed embodiment, this air duct opening 50 comprises a horizontal foil 54, two vertical side-foils 53, and the hatch cover 85. When the watercraft is in motion, ambient air will move relative to the watercraft, flowing over the upper deck 20 of the watercraft and traveling into the air duct opening 50, where foil 54, side-foils 53, and hatch cover 85 confine and channel the air, redirecting this air towards the rider's area 40. In an alternate embodiment (not shown), the air duct opening 50 may be larger towards the bow portion 30 of the watercraft than towards the stern 170, thereby funneling the moving air towards the rider's area 40 at an increased velocity due to the decreasing cross-section of the air duct opening 50.

The seat 70, which will be described in detail below, is provided in the rider's area 40. The seat 70 desirably is a straddle-type seat having an elongated shape that extends along the longitudinal axis of the watercraft. The seat is centrally located between the sides of the hull.

As illustrated in phantom in FIGS. 1 and 2, a fuel tank 55 is located within the hull 10. A fuel filler hose 60 extends from the surface of deck 20 to the fuel tank 55. Conventional means such as straps (not shown) secure the fuel tank to the lower hull 15. In the illustrated embodiment, a filler cap assembly 65 is secured to the bow portion 30 of the hull upper deck 20. In this manner, the fuel tank 55 may be filled from outside the hull 10 with the fuel passing through the fuel filler hose 60 into the tank 55.

An oil tank 110 is provided above the fuel tank 55. An oil filler port 115 of the oil tank 110 is provided on the upper deck 20 to the side and in front of the control mast 35.

An in-line, three-cylinder, two-cycle crankcase compression engine 90 is mounted in the center of the main body of the watercraft; however, other types of engines also can be used to power the watercraft. For instance, engines with other numbers of cylinders, with other cylinder arrangements and which operate on other operating principles (e.g., four-stroke) can be used for this purpose.

The engine 90 desirably is oriented within the hull 10 to locate a crankshaft 95 of the engine 90 along a longitudinal axis of the main body. The engine 90 is mounted above the bottom 100 of the watercraft through a damper member or mount 105.

A bulkhead 120 desirably is vertically provided behind the engine 90 and divides the main body 2 into an engine chamber or compartment 125 and a propulsion chamber 130. Air ducts 45 for guiding air into the engine chamber 125 are provided in the forward/rear parts of the engine chamber. Air inlet ports of each air duct 45 are connected to openings formed in the upper deck 20. Outlet ports of each air duct 45 are respectively opened to the rear side of the engine and forward side of the fuel tank 55. Although air is supplied to the engine compartment 125 through both ducts, a flow of air from the front duct to the rear duct also occurs to air cool the engine and the other components of the watercraft located in the engine compartment 125.

A jet propulsion unit, indicated generally by reference numeral 140, is provided in the propulsion chamber 130. This jet propulsion unit 140 includes a propulsion shaft 145 to which an impeller (not shown) is fixed. The propulsion shaft 145 is positioned in the forward/rear directions and extends through an intake duct 150 that has a water inlet port 160 positioned on the keel of the hull bottom 100. The lower hull section 15 includes an opening at the stem 170 of the watercraft 5 in which an outlet nozzle 165 of the propulsion unit 140 is positioned. A front end of the propulsion shaft 145 and crankshaft 95 of the engine are coupled through a coupling 175 to transfer force from the crankshaft to the propulsion shaft. The propulsion unit 140 generates the propulsive force by applying pressure to water drawn up from the water inlet port 160 by means of the rotation of the propulsion shaft 145, and forcing the pressurized water through the outlet nozzle 165 in a manner well known to those skilled in the art.

A nozzle deflector or steering nozzle 180 is connected to the outlet port 165 of the propulsion unit 140. The nozzle deflector 180 desirably moves in the left/right and vertical directions via a known gimbal mechanism. The nozzle deflector 180 is connected to the steering handle 75 through a steering mechanism and trim mechanism (not shown), whereby the steering and trim angles may be changed by the operation of the steering handle 75 and associated trim controls.

On one side of the engine 90, an intake system (not shown) is provided. On the other side of the engine 90 the exhaust system is provided. In the exhaust system, an exhaust pipe 190 extends from the front side of the engine and bends to the rear direction. A downstream end of the exhaust pipe 190 is connected through a front end of a water lock or trap 195. The water lock 195 inhibits a reverse flow of water toward the engine. In the rear end of the water lock 195, a through-hull exhaust pipe 200 is connected. This exhaust pipe 200 extends upwardly and across the hull and over the pump chamber, and is connected to a pump chamber of the watercraft to exhaust at this location.

The upper deck 20 of the watercraft includes a longitudinally extending pedestal 203, preferably formed as part of the upper deck. Foot areas 280 are formed along side this pedestal 203, between the pedestal 203 and a pair of raised side gunnels or bulwarks 283 that extend along the outer sides of the watercraft in the rider's area 40. These foot areas 280 are sized to accommodate the lower legs and feet of the riders who straddle the seat 70 when seated. In the illustrated embodiment, the foot areas merge into a rear deck 204 formed at the rear of the watercraft behind the pedestal. The rear deck 204 extends above the jet unit 140 and allows eased entry into the watercraft 5, as is well known in the art. At the end of the foot areas 280 near the rear deck 204, a foot rest 207 is provided on either side of the pedestal 203 near the inner wall of the respective bulwark 283. Each foot rest 207 is slanted and rises toward the watercraft stem 208.

As best seen in FIG. 2, each foot area 280 also includes a drainage system. The drainage system includes a drainage hole 284 and a drainage line 286 that discharges water received by the drainage hole 284 back to the body of water in which the watercraft 5 is operated. In the illustrated embodiment, the drainage line 284 terminates next to the exhaust discharge opening in the tunnel of the lower hull portion 15; however, the line could terminate at other locations, such as on the side of the watercraft 5 or on the stem 208 of the watercraft.

A maintenance opening 265 is formed on the top surface 206 of the seat pedestal 203 and is positioned below the seat 70. This maintenance opening 265 is covered by the bottom plate of the seat 70 in a water sealing manner. The engine chamber 125 can be accessed through this maintenance opening 265 by removing the seat 70.

A second opening 270 is formed in the top surface of the pedestal 203, behind the maintenance opening 265, and is similarly positioned below the seat 70. A storage box 275 may be removably provided in this second opening 270. Preferably, the storage box 275 has a flange (not shown) formed along the exterior of its upper edge, by which it engages and is secured into the second opening 270. In the illustrated embodiment, the top of the storage box 275 is covered by the bottom plate of the seat 70 in a water sealing manner. A rider may access the hull in the area behind the bulkhead 120 and above propulsion chamber 130 (i.e., the chamber of the hull in which the jet pump unit 140 is located) by opening/removing at least a portion or element of the seat assembly 70, and then subsequently removing the storage box 275 from the second opening 270.

The seat assembly, indicated generally by reference numeral 70, extends longitudinally along the hull and is attached to the pedestal 203. The seat assembly typically incorporates a first rider section 300, a second rider section 305, and a third rider section 310. In the disclosed embodiment, these rider sections are separated by humps or protrusions 320 which assist the riders in maintaining their longitudinal position on the seat assembly. The seat assembly may be formed of a single unit, or may incorporate a plurality of independent seat sections. In addition, the upper surfaces of the different sections of the seat assembly may be located at different elevations in order to allow the second and/or third rider(s) on the watercraft to see over the rider(s) seated in front of them. In the illustrated embodiment, the first and second sections 300, 305 are formed together in a unitary front seat element which is releasably attached to the pedestal 203. The third section 310 is a separate rear seat element which is also releasably attached to the pedestal 203. The front and rear seat elements either can be removed from the pedestal 203 independent of each other, or a latching mechanism can be located to require the removal of the rear element before the front element can be removed.

The first seat section 300 includes a generally flat seat portion 301 and a generally upstanding surface 302 formed on the front side of the hump 320 that separates the first and second sections 300, 305. The second seat section 305 likewise includes a generally flat seat section 306 and a generally upstanding surface 307 formed on the front side of the hump 320 that divides the second and third sections 305, 310. The third seat section 310 includes a generally flat seat surface 311. In the illustrated embodiment, the third seat surface 310 is at an elevated level relative to the second seat section 306, and the second seat section 305 is at an elevated level relative to the first seat section 300. This advantageously positions the riders at different levels, as noted above.

Figure 3:
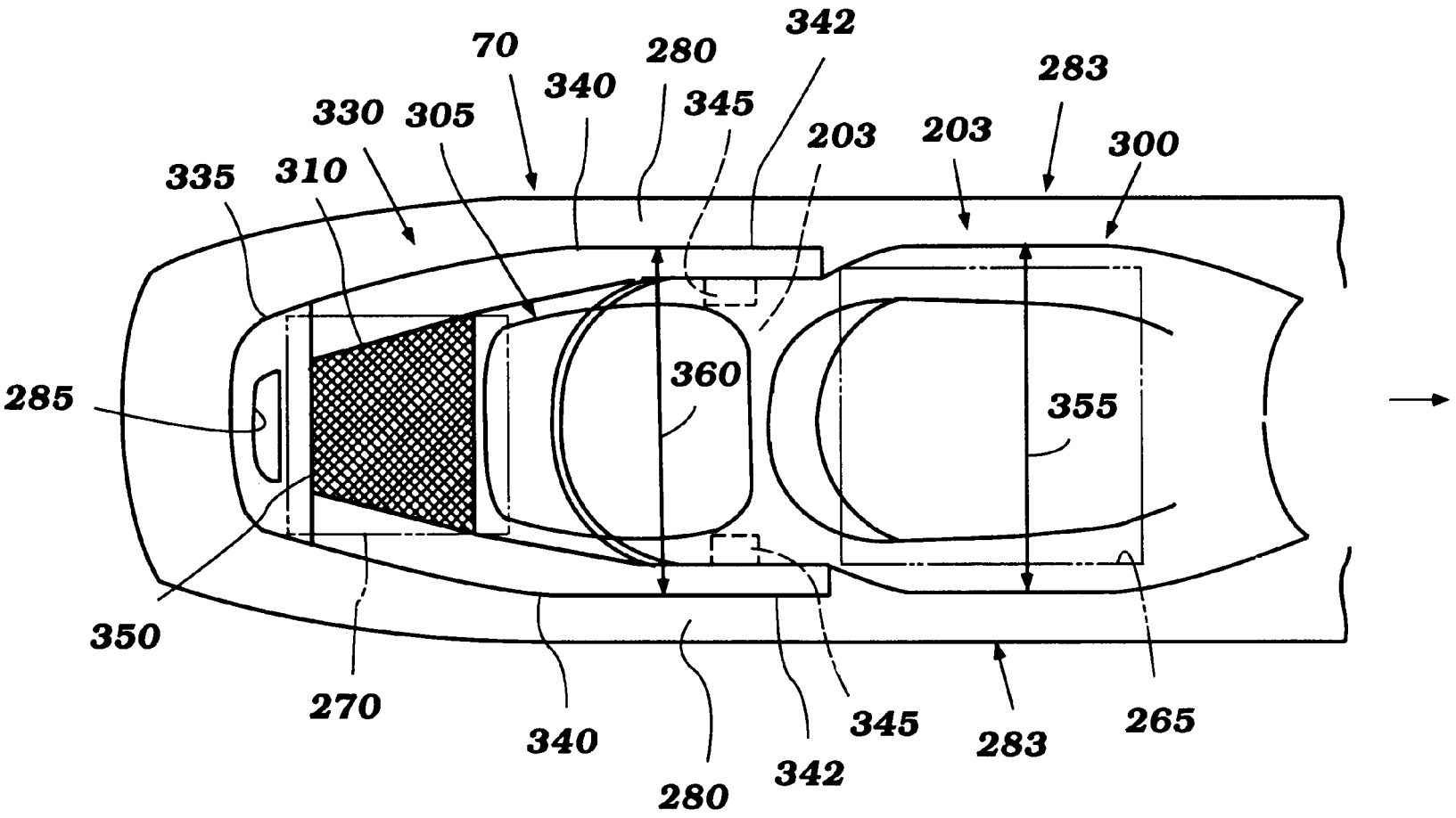
FIG. 3 is a top plan view of the elongated seat of FIG. 2.
Figure 4:
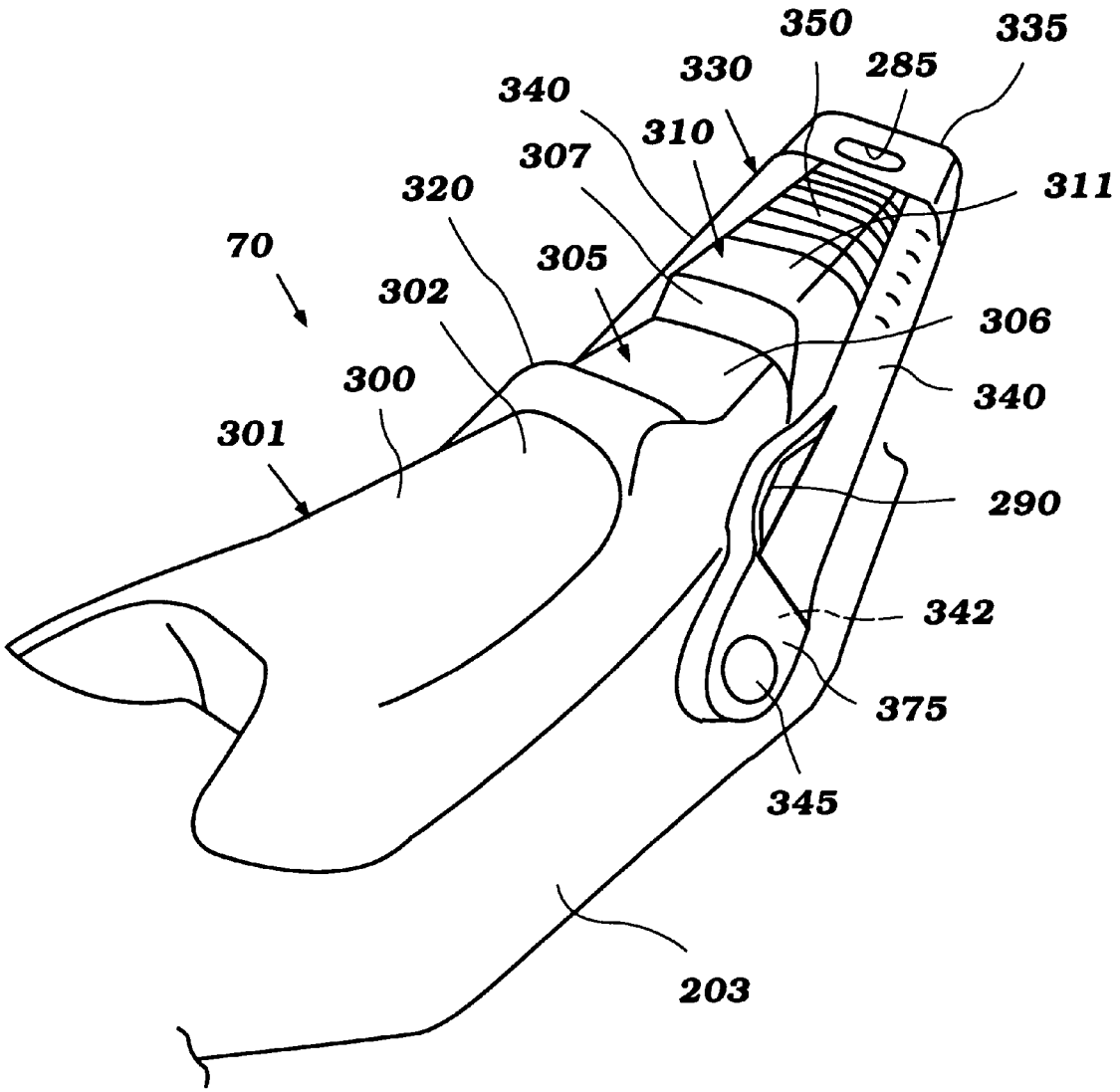
FIG. 4 is a side elevational perspective view of the elongated seat of FIG. 2.

With reference to FIGS. 3 and 4, a moveable rider support, generally designated by reference numeral 330, is also provided on the hull upper deck 20. The moveable rider support 330 comprises a transverse support rest 335 attached to at least one support arm 340. In the illustrated embodiment, two support arms 340 support the support rest 335. Each of the support arms 340 desirably is connected to a pivot housing 342 at an end opposite the support rest 335. The pivot housing 342 is connected to and surrounds the pivot mounts 345, which are rotatably secured to the upper deck 20. In the illustrated embodiment, the pivot mounts 345 are attached to the pedestal 203.

A cushion (see FIG. 4) or support mesh or webbing (see FIGS. 2 and 3), which are generally designated by reference numeral 350, desirably is attached to the support arms 340 and to the support rest 335 so as to provide increased upper/middle back support for a rider.

In the illustrated embodiment, a portion of the support rest 335 forms a grab bar 285. This grab bar 285 may be used by a rider seated in the third seat section to maintain his or her balance while sitting on the seat 70.

As best depicted in FIG. 3, the transverse width of the first rider section 300, indicated as first section width 355, is chosen so as to allow a first rider to comfortably straddle the elongated seat without requiring an unduly wide separation of his or her legs. Because the support arms 340 are mounted external to the pedestal 203, however, a third rider will be required to straddle both the second rider section 305 and the support arms 340 with his or her legs when the third rider is riding on the elongated seat 70 on the third rider section 310. Preferably, therefore, the transverse width of the support arms 340 and second rider section 305, indicated as the third section width 360, will not greatly exceed the first section width 355.

As best depicted in FIGS. 1 and 4, a handle 290 is provided on each support arm 340, positioned along said support arm approximately one-third of the distance from the pivot mount 345 to the support rest 335. Both handles 290 may be used by a second rider to maintain his or her balance while sitting on the second rider section 305 of the seat 70.

FIGS. 5 through 8 best illustrate the construction of one of the mounts 345 which pivotally attach the respective support arm 340 to the pedestal 203. Although the following description and the illustrations in these drawings only relate to the port side mount 345, it should be understood the mounts are generally mirror images of one another, and the description and illustrations equally apply to both mounts unless mentioned otherwise.

Figure 5:
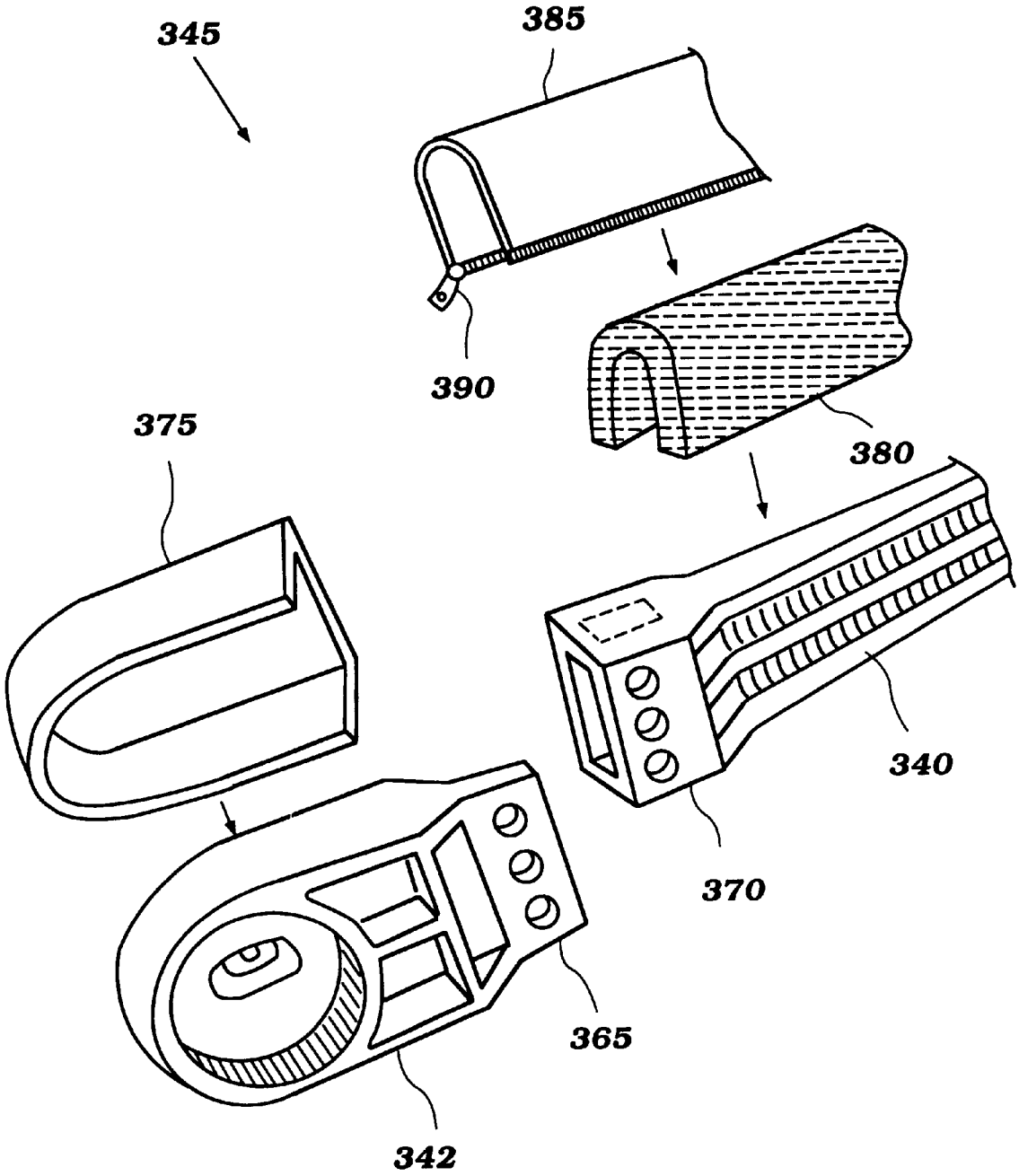
FIG. 5 is an exploded view of the support arm and pivot assembly.
Figure 6:
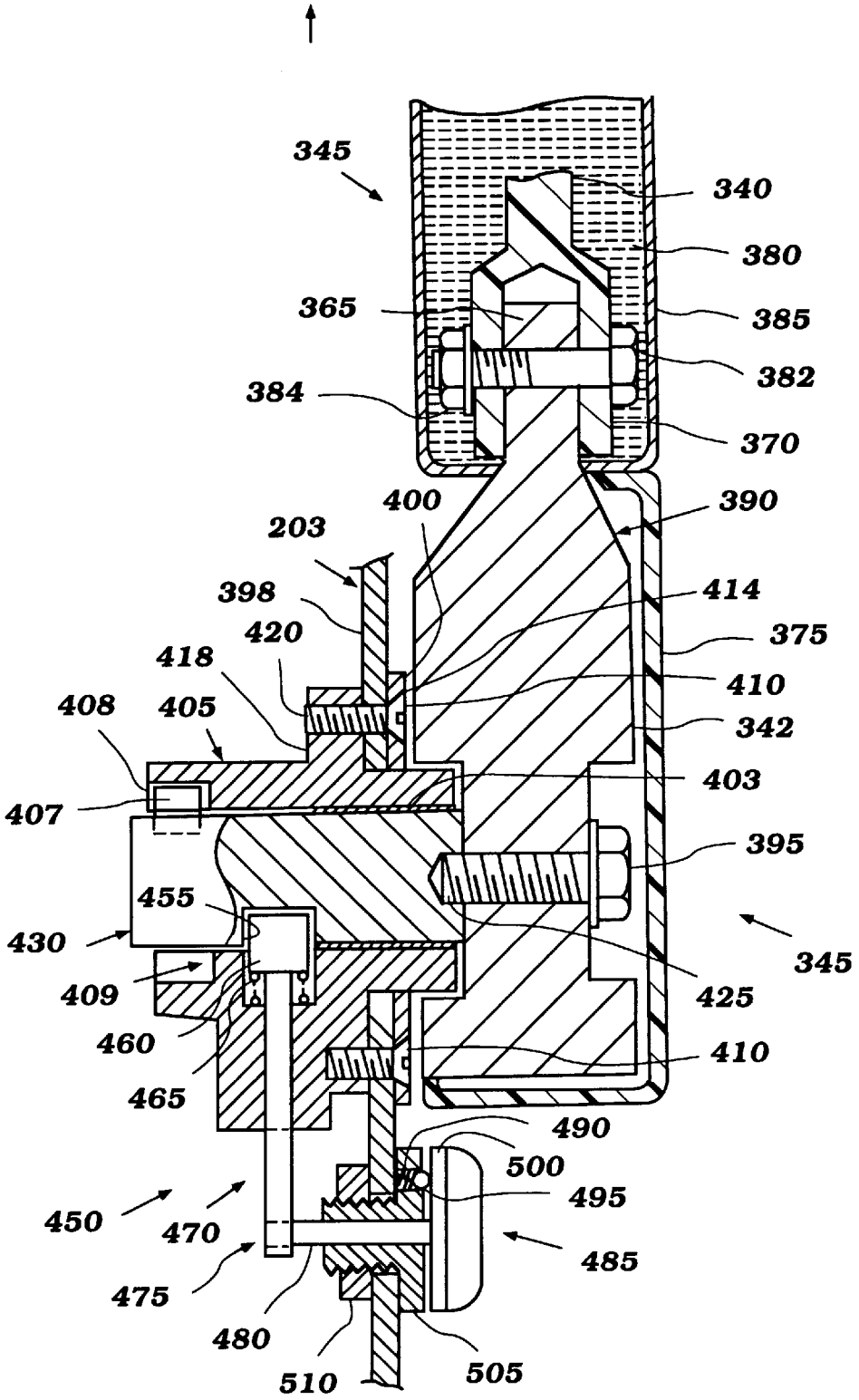
FIG. 6 is a cut-away cross-sectional view of one embodiment of a support arm and pivot assembly.

With reference to FIGS. 5 and 6, the transverse width of the pivot housing 342 gradually reduces at the neck 390, becoming a minimum width at a connection tab 365, which fits into a corresponding connection housing 370 of the support arm 340. The pivot housing 342 may then be secured to the support arm by nuts 384 and bolts 382 or by other fasteners well known in the art.

As can be seen most clearly in FIG. 5, the pivot housing 342 is covered by a protective cover 375, which serves to protect the legs of the riders from the hard surfaces and/or sharp edges of the pivot housing 342. The support arms 340 are similarly enclosed by a cushioning material 380, such as a coated or sealed rubber or fabric sponge, which cover the hard surfaces and sharp edges of the support arm 340 and the associated mounting hardware (not shown). The cushioning material 380 can be adhered directly to the support arm 340, or can be secured to the support arms by an outer sheath 385, as illustrated in FIG. 5. The outer sheath 385 is typically comprised of a stretchable, some what flexible material such as rubber, plastic, or fabric, to which is attached a zipper 390. In order to secure the outer sheath to the support arm 340, it is necessary to stretch the outer sheath 385 around the support arm 340 and cushioning material 380 and close the zipper 390 or similar fastener, such as, for example, snaps, buttons and the like. The outer sheath will then tend to resume its original unstretched shape, thereby squeezing the cushioning material 380 and securing the outer sheath 385 and cushioning material 380 to the support arm 340 in a manner well known to those of ordinary skill in the art.

Figure 8:
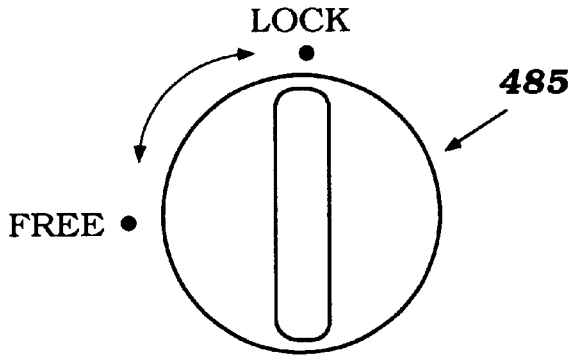
FIG. 8 is a frontal view of a pivot mechanism locking switch.

As best seen in FIGS. 6 and 8, the pivot housing 342 is secured to a pivot shaft 430 by a bolt or by other means well known to those skilled in the art. In the illustrated embodiment, the pivot shaft 430 is secured to and rotates concurrently with the pivot housing 342. While FIG. 6 shows only a single turn of the bolt thread 425 securing the pivot mount 345 to the pivot shaft 430, it should be recognized that by increasing the number of bolt threads securing the pivot shaft 430, the strength of the connection may be enhanced. It should also be recognized that, while a single bolt will be sufficient to secure the pivot mount 345 to the pivot shaft 430, the use of multiple bolts could strengthen this connection.

Figure 7:
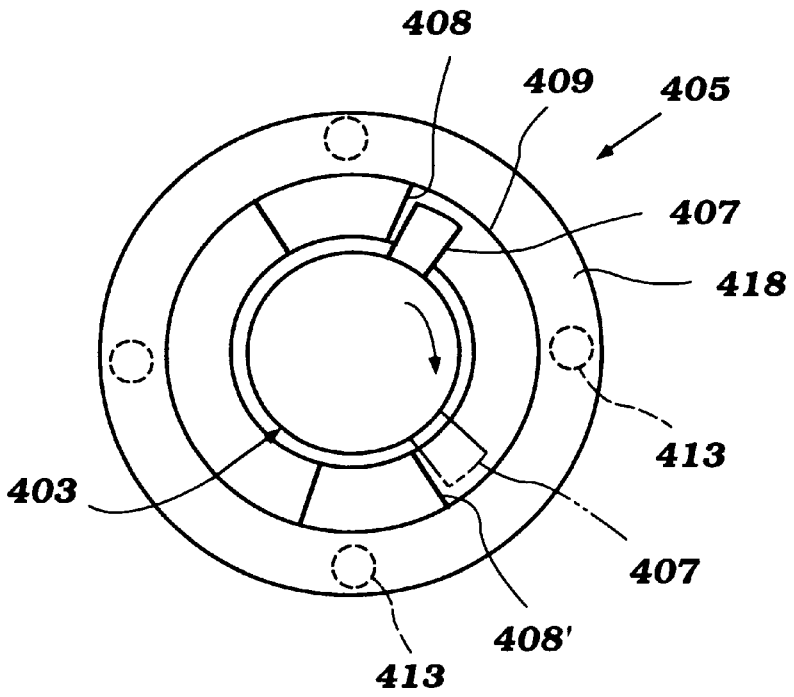
FIG. 7 is a side elevational view of a pivotal coupling, viewed from inside the hull of the watercraft.

With reference to FIGS. 6 and 7, the pivot shaft 430 rotates within the shaft tube or bushing 405, and is prevented from rotating out of the shaft tube 405 by the interaction of a shaft key 407 with a shaft tube indent 409. In addition, the shaft key 407 desirably inhibits the shaft tube 405 from rotating beyond a predetermined rotation range. This is accomplished by providing rotation stops 408, 408' (best seen in FIG. 7) that come in contact with shaft key 407 as the pivot shaft 430 rotates. For example, as the pivot shaft 430 rotates counterclockwise in FIG. 7, shaft key 407 will contact rotation stop 408, thereby preventing further rotation of the pivot shaft 430 in the counterclockwise direction. Similarly, as the pivot shaft 430 rotates in the clockwise direction, the shaft key 407 will rotate to a new position, come in contact with rotation stop 408', and thereby prevent further clockwise rotation of the pivot shaft 430.

In order to ensure smooth rotation of the pivot shaft 430 within shaft tube 405, as well as to limit water leakage through the shaft tube 405, a bushing or bearing assembly 403 is positioned between the shaft tube 405 and the pivot shaft 430 in a manner well known to those of ordinary skill in the art.

The shaft tube 405 is secured to a wall 398 of the pedestal 203 by interposing the wall 398 between a flange 418 of the shaft tube 405 and an outer securing plate 400, and thereafter fastening the flange 418 to the outer securing plate 400 by fasteners such as bolts or screws 410. A plurality of screw openings 413 are machined into the flange 418, which desirably correspond to the threads of the screws 410. The screw openings 413 in the surface 414 of the outer securing plate 400 is desirably counter-sunk to lower the heads of the screws 410 to a position flush with the surface 414 in a manner well known in the art.

A locking mechanism, indicated generally by reference numeral 450, serves to lock and unlock the pivot shaft 430. The locking mechanism 450 thus serves to selectively allow free rotation of the pivot arms 340 when so desired, and to lock the pivot shaft 430 in one of a plurality of positions when so desired. The locking mechanism comprises a plurality of shaft holes 455 formed in the pivot shaft 430, a shaft stop 460, a biasing mechanism 465 (e.g., a compression spring), a pull arm 470, a swing arm or lever 475, a twist shaft 480, a selector dial 485, a detent spring 490, a detent ball 495, a detent ring 500, a selector base 505 and a base back plate 510. The pedestal wall 398 is interposed between the selector base 505 and the base back plate 510, thereby securing the selector base 505. The selector dial 485 is connected to the detent ring 500, which in turn is connected to the twist shaft 480. The twist shaft 480 is connected to the swing arm 475, which is coupled to the pull arm so as to move the pull arm when the twist shaft is turned. The pull arm 470 is connected to the shaft stop 460.

During normal watercraft operation, the detent spring forces the detent ball 495 into a depression (not shown) in the detent ring 500 so as to prevent unintentional rotation of the selector dial 485 in a manner well known to those skilled in the art. When a rider desires to alter the position of the moveable rider support 330, the rider twists the selector dial 485, overcoming the detent mechanism, subsequently causing the attached twist shaft 480 to rotate in a counterclockwise direction. This motion of the twist shaft 480 is transferred to the attached swing arm 475, which moves the pull arm 470 in a direction away from the pivot shaft 430 in a manner well known to those skilled in the art. This movement of the pull arm 470 overcomes the force produced by the biasing spring 465, thereby lifting the attached shaft stop 460 out of the shaft hole 455 and allowing the pivot shaft 430 to rotate freely to a new desired position. When the moveable rider support (not shown) is in its new desired direction, the rider releases the selector dial 485, which subsequently allows the biasing spring 465 to push the shaft stop 460 into the new shaft hole 455, thereby preventing further rotation of the pivot shaft 430.

The shaft holes 455 are positioned around a portion of the pivot shaft 430. At least one (a first end hole) of the holes desirably corresponds to the position of the shaft 430 when the key 407 abuts one of the stops 408, and another hole (a second end hole) corresponds to the shaft position when the key 407 abuts the other stop 408'. A third hole desirably is positioned at a location between the end holes. In the illustrated embodiment, the first end hole 455 is positioned on the shaft 430 such that the support arms 340 generally lie in a position that supports the support rest 335 just above the back edge of the third seat section 310, as seen in FIG. 1. The middle hole 455 is spaced generally about 25° from the first end hole such that the support arms 340 support the support rest 335 in a position just behind the second seat section 305, as seen in FIG. 1. The second end hole 455 is spaced generally about 60° from the first end hole such that the support arms 340 support the support rest 335 in a position just behind the first seat section 300, as seen in FIG. 1. The advantages of these positions of the support rest 335 along the longitudinal axis of the watercraft 5 and central seat 70 relative to the riders' positions will be described below. These positions also offer advantages when servicing the watercraft 5.

In order to safely support the watercraft while in an inverted position, the surface of the moveable rider support desirably lies flat against the floor to increase the stability of the support structure. In the illustrated embodiment, this may be accomplished by forming the grip 285 with a flat upper face, or by removing the grip from moveable rider support prior to inverting the watercraft, thereby resting the inverted watercraft on the support rest 335 and/or support arms 340.

In order to best facilitate underbelly maintenance of an inverted watercraft, the movable support 330 allows the inverted watercraft 5 to be supported bow-down or stern-down, depending upon the section of the underbelly to be accessed. As seen in FIG. 1, the moveable rider support 330 can be pivoted to a number of support positions, the first of which positions the support rest 335 and grip 285 above a horizontal level 521 and even with the top of the steering cover 80. This first support position 522 allow the inverted watercraft (not shown) to be supported in a bow-down support position (not shown). The second disclosed support position 523 of the moveable rider support 330 would position the support rest 335 and grip 285 even with the horizontal level 521, thereby positioning the inverted watercraft in a level-keel support position (not shown). The third disclosed support position 524 of the moveable rider support would position the support rest 335 and grip 285 below the horizontal level 521, thereby supporting the inverted watercraft in a stern-down support position.

Figure 9:
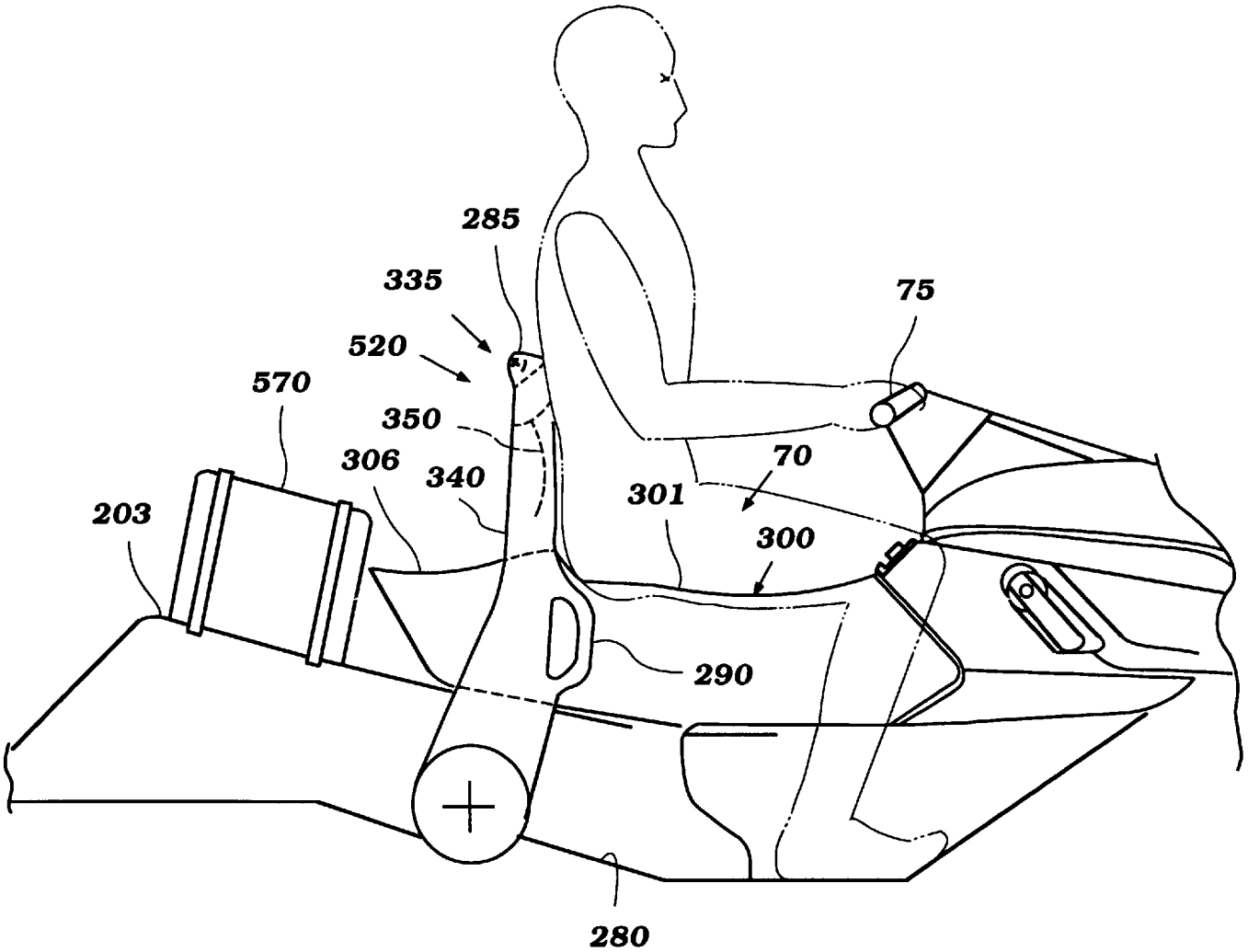
FIG. 9 is a side elevational view of a watercraft configured with one embodiment of the present invention positioned in a Single-Rider Support Position.

FIG. 9 shows a single rider on the watercraft, with the moveable rider support of the present invention in the Single-Rider Support Position 520. In this position 520, the support rest 335 is suitably positioned so that the rider's upper back will maintain contact with the support rest 335 while the rider is operating the watercraft. In addition, the cushion, support mesh or webbing 350 can serve to support the middle back of the rider while in this position 520. As may also be seen from this figure, an alternate seat design is disclosed that allows a storage container 570 (to be described later) or other cargo to be secured to the pedestal 203 of the watercraft.

Figure 10:
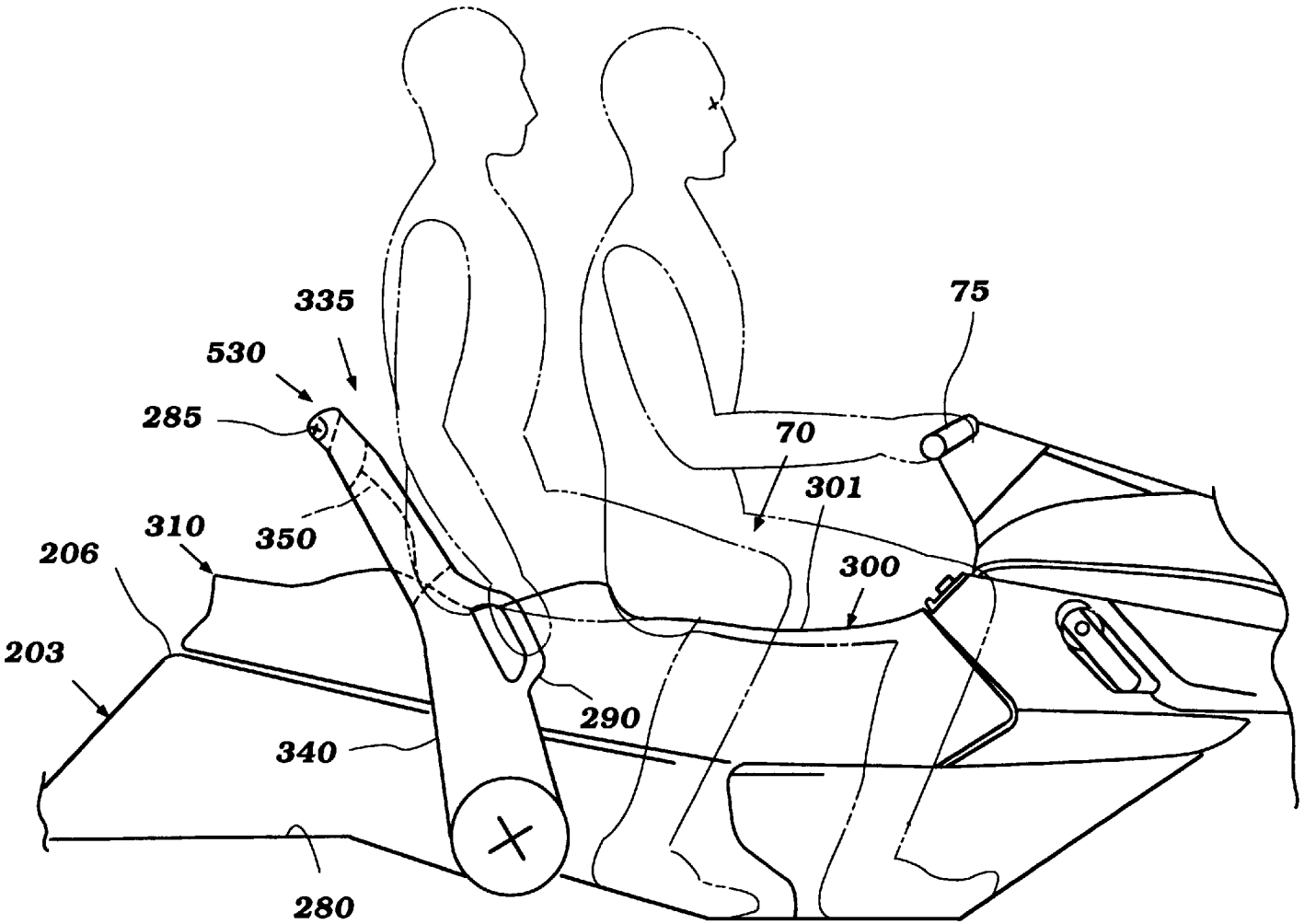
FIG. 10 is a side elevational view of a watercraft configured with an alternate embodiment of the present invention positioned in a Second-Rider Support Position.

FIG. 10 shows a second rider on the watercraft, with the moveable rider support of the present invention in the Second-Rider Support Position 530. In this position 530, the support rest 335 is suitably positioned so that the second rider's middle and/or lower back will maintain contact with the support rest 335 and/or cushion, support mesh or webbing 350 while the second rider is riding on the elongated seat 70. In addition, the second rider may grasp the handles 290 of the support arms 340 to secure his or her position on the watercraft.

Figure 11:
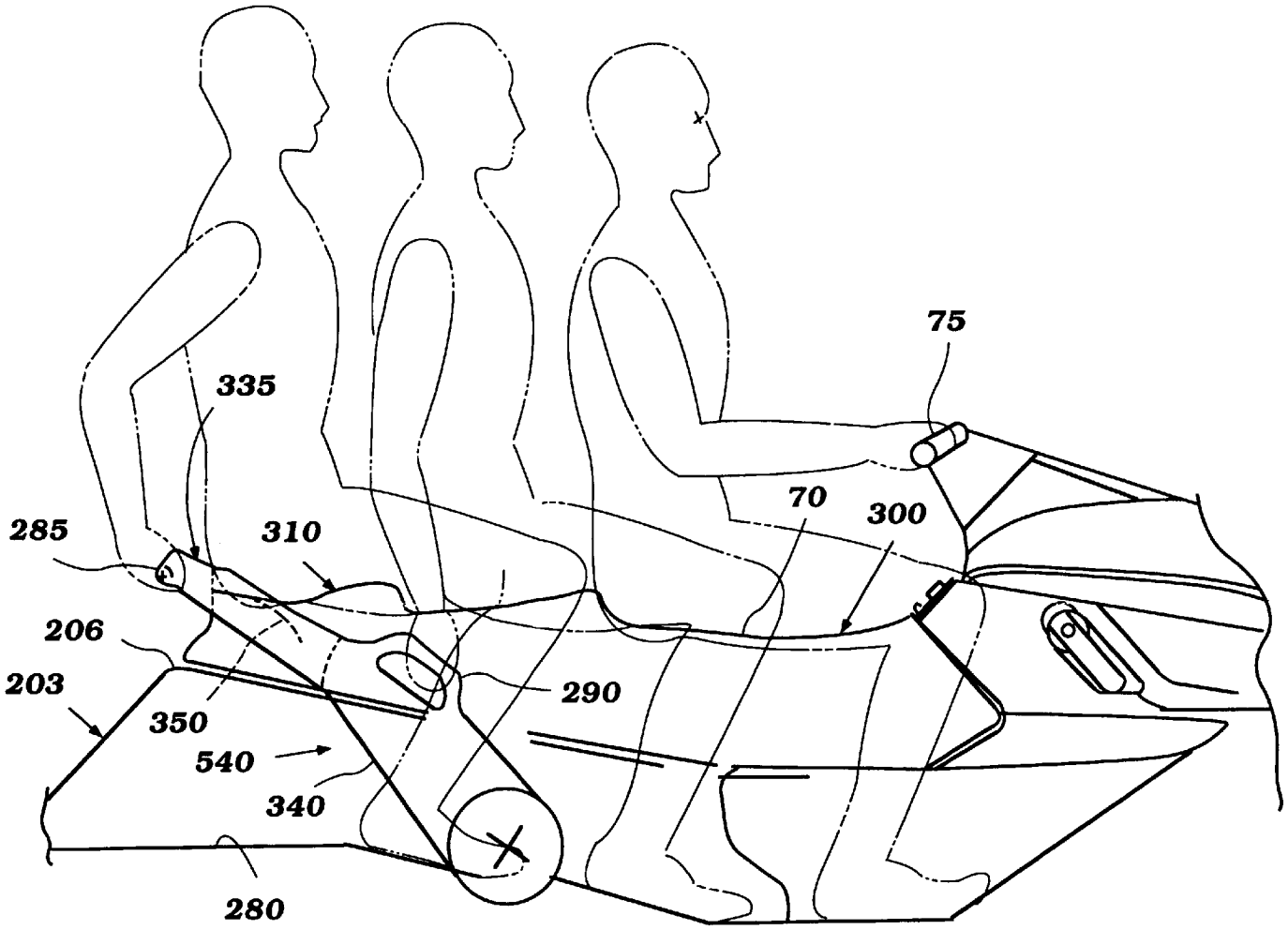
FIG. 11 is a side elevational view of the watercraft of FIG. 10 with the embodiment of the present invention positioned in a Third-Rider Support Position.

FIG. 11 shows a third rider on the watercraft, with the moveable rider support of the present invention in the Third-Rider Support Position 540. In this position 540, the support rest 335 is suitably positioned so that the cushion, support mesh or webbing 350 and/or the support rest 335 inhibit the third rider from traveling off the stern end of the elongated seat 70. In this position 540, the third rider may grasp the grip 285 located behind his or her back in order to secure his or her position on the watercraft. Similarly, the second rider may grasp the handles 290 of the support arms 340 to secure his or her position on the watercraft.

Figure 12:
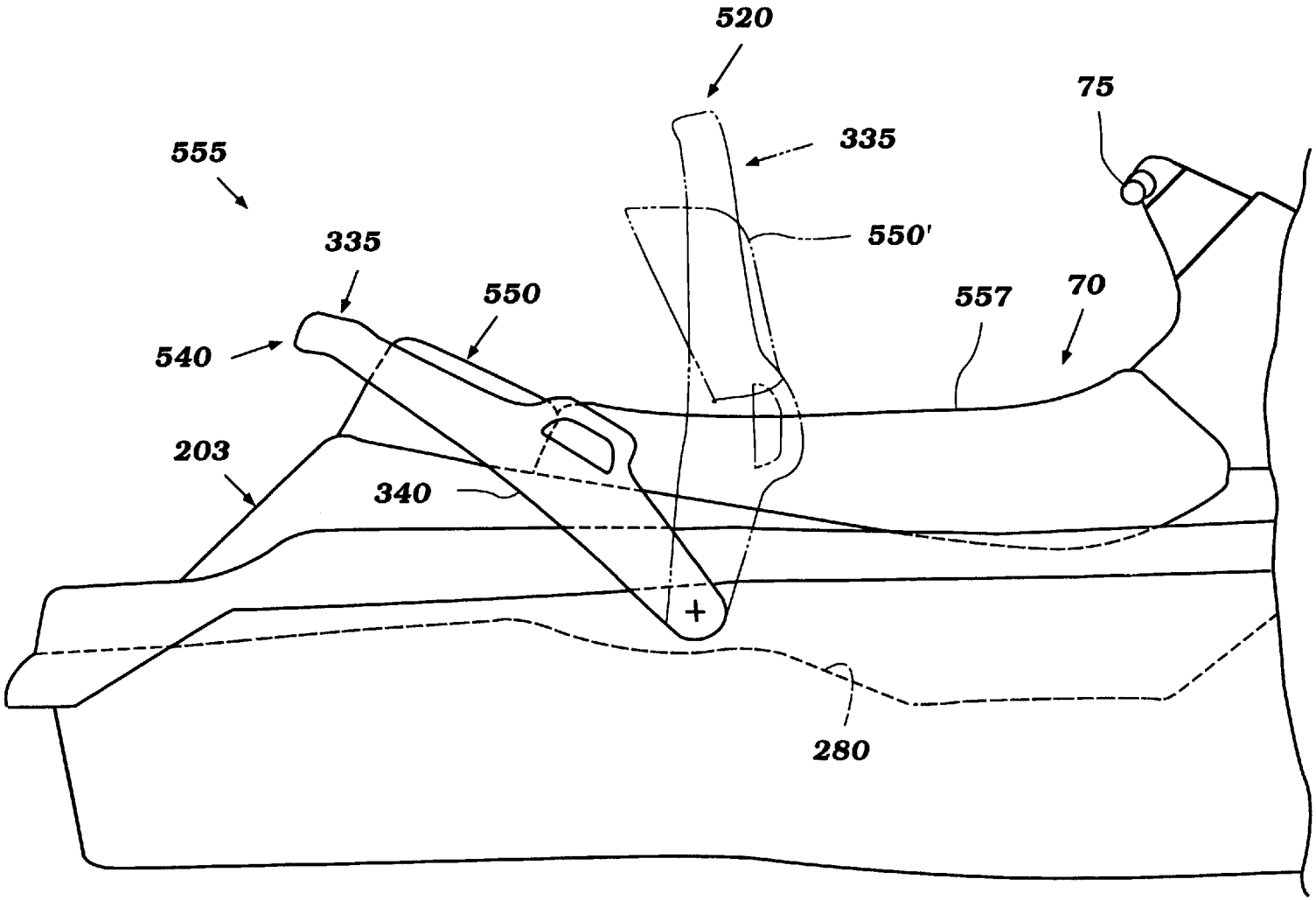
FIG. 12 is a side elevational view of another alternate embodiment of the present invention.

FIG. 12 depicts an alternate embodiment of a moveable rider support constructed in accordance with the present invention, in which a second seat section 550 is secured to the support arms 340 and support rest 335 of the moveable rider support 555. In this embodiment, the second seat section 550 serves to support a third rider when the moveable rider support 555 is in the Third-Rider Support Position 540. However, when the moveable rider support 555 is in the Single-Rider Support Position, the second seat section 550 lifts off the pedestal 203 and supports the upper and middle back of a single rider while the rider is seated on a first seat section 557 and operates the watercraft.

Figure 13:
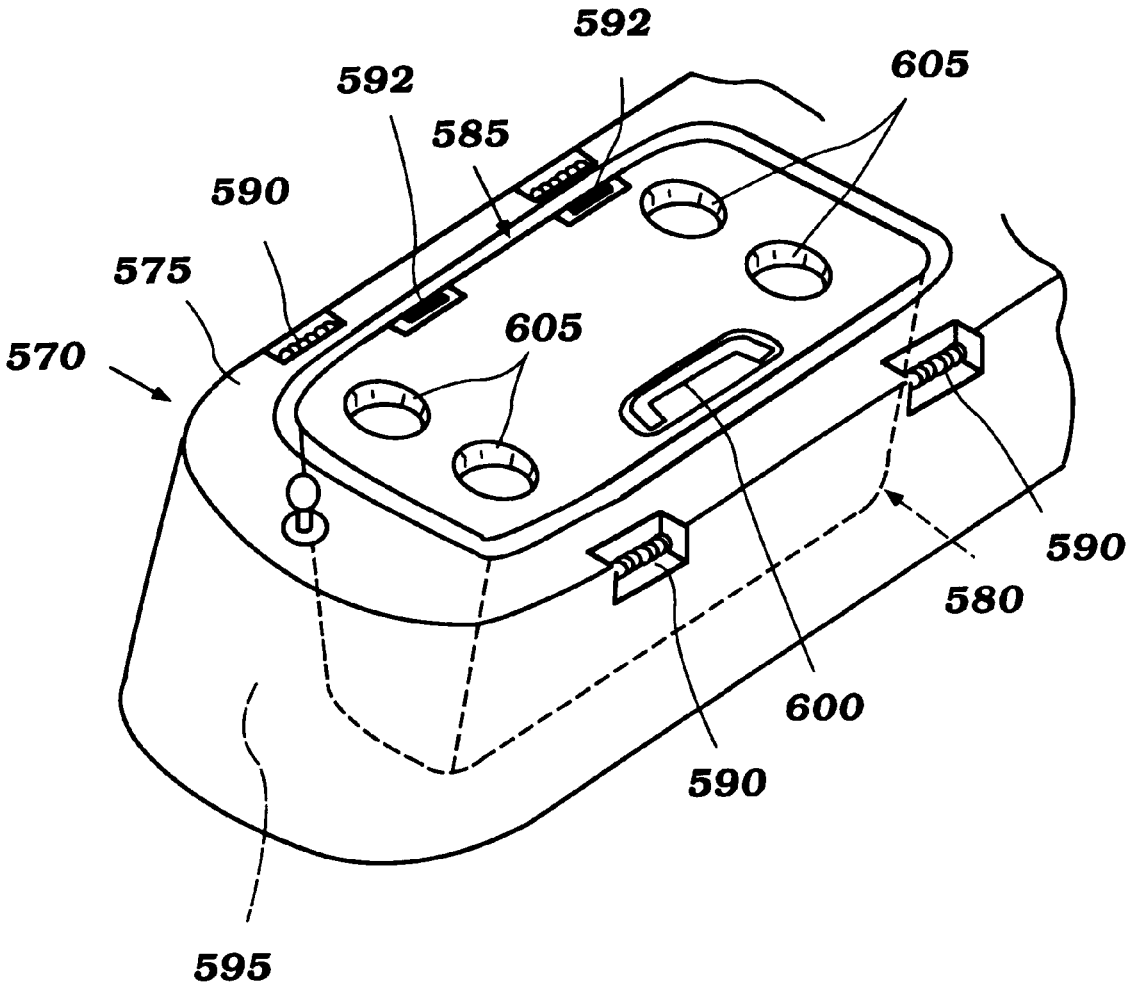
FIG. 13 is a side elevational perspective view of a storage container.

With reference to FIG. 13, there is depicted an external storage box 570 suitable for use with various embodiments of the present invention. Because the external storage box 570 is not permanently secured to the watercraft, it may be removed from the watercraft and used by the riders wherever desired. In addition, various other types of cargo may be secured to the watercraft in place of the external storage box 570. The external storage box 570 comprises an outer body 575, an inner body 580, a lid 585, one or more hinges 592, and one or more tie-down sockets 590. The interior 595 between the inner body 580 and the outer body 575 desirably comprises an insulating material or dead-air space in order to preserve the temperature of the contents (not shown) of the inner body 580. A handle 600 and one or more cup holders 605 may be positioned on the lid 585 in order to facilitate access and use of the external storage box 570. In the disclosed embodiment, the external storage box 570 is secured to the upper body of the watercraft by straps (not shown), but it may also be secured to the watercraft in any number of ways commonly known to those skilled in the art.

Accordingly, although this invention has been described in terms of certain preferred embodiments, other embodiments apparent to those of ordinary skill in the art are also within the scope of this invention. Of course, a watercraft need not include all of these features to appreciate some of the aforementioned advantages associated with the present watercraft. Accordingly, the scope of the invention is intended to be defined only by the claims that follow.

What is claimed is:

1. A small watercraft comprising a hull having a longitudinal axis and an upper deck portion, an elongated seat positioned on the upper deck portion of the hull, and a rider support comprising a support rest, said support rest being movably coupled to the upper deck portion of the hull to be moved between at least first, second and third longitudinal positions along the longitudinal axis, the support rest lying between the first and second rider positions when in the first longitudinal position, lying between the second and third rider positions when in the second longitudinal position, and lying behind the first, second and third rider positions when in the third longitudinal position.

2. A small watercraft as in claim 1, wherein at least one support arm supports the support rest relative to the seat.

3. A small watercraft as in claim 2, wherein a pivot mount rotatably couples the support arm to the upper deck portion, whereby as said support arm rotates about said pivot, said support rest moves from the first position to the second position along the longitudinal axis.

4. A small watercraft as in claim 2, wherein the support arm includes an integral grip.

5. A small watercraft as in claim 1, wherein said support rest extends in a direction generally normal to the longitudinal axis.

6. A small watercraft as in claim 5, wherein said seat includes a hump located between first and second rider positions on the elongated seat, and the support rest is generally above the seat hump when in the first longitudinal position.

7. A small watercraft as in claim 5, wherein said seat includes a first seat element and a second seat element, at least the second seat element being releasably attached to the upper deck portion of the hull, and at least one of the longitudinal positions of the support rest is generally above the second seat element.

8. A small watercraft as in claim 5, wherein said seat includes a first seat element and a second seat element, the second seat element being releasably attached to a platform.

9. A small watercraft as in claim 8, wherein said platform includes an opening into the hull.

10. A small watercraft as in claim 5, wherein the rider support is mounted to the upper deck portion on both sides the elongated seat.

11. A small watercraft as in claim 1, additionally comprising a maintenance opening in an upper deck portion of the hull and being positioned in proximity to said rider support.

12. A small watercraft of claim 1, wherein said rider support includes a locking mechanism to selectively lock the support rest in said longitudinal positions.

13. A small watercraft as in claim 12 additionally comprising a steering operator arranged on the upper deck portion in front of the seat, and at least one of the longitudinal positions of the support rest is higher than a level of the steering operator.

14. A small watercraft as in claim 13, wherein a least one of the longitudinal positions of the support rest is lower than the level of the steering operator.

15. A small watercraft as in claim 1, wherein said seat includes at least a first seat section and a second seat section, and said second seat section is fixed to said rider support.

16. A small watercraft as in claim 1, wherein said seat includes a first-rider section and a second-rider section, said second-rider section having an upper surface located at a higher elevation than an upper surface of said first-rider section.

17. A small watercraft comprising a hull having an upper deck portion, a seat positioned on the upper deck portion of the hull, a rider support comprising a support rest, said support rest being supported generally above the seat by at least one support arm and a movable coupling that attaches the support arm to the upper deck portion of the hull, and a steering control position forward and above the seat, the support rest being movable between at least first and second positions, an upper end of the support rest being positioned no higher than the height of the steering control when the support rest is in the first position and being positioned higher than the height of the steering control when the support rest is in the second position.

18. A small watercraft as in claim 17, wherein the pivotal coupling includes first and second stops which define a range of angular travel of the support arm about a rotational axis of the pivotal coupling.

19. A small watercraft as in claim 18, wherein the pivotal coupling includes a lock device which selectively establishes fixed predetermined positions of the support arm through the range of angular travel.

20. A small watercraft as in claim 19, wherein the seat has an elongated shape comprising a first rider position and a second rider position, and at least in one of the predetermined positions, the support arm locates the support rest between the first and second rider positions.

21. A small watercraft as in claim 20, wherein the support arm locates the support rest generally behind the first and second rider positions on the seat when the support arm is positioned within another of the predetermined position.

* * * * *